US010549211B2

(12) United States Patent
Gharibian et al.

(10) Patent No.: US 10,549,211 B2
(45) Date of Patent: Feb. 4, 2020

(54) BATH BOOK

(71) Applicant: MUNCHKIN, INC., Van Nuys, CA (US)

(72) Inventors: Nairi Gharibian, Glendale, CA (US); Kevin Douglas Johnson, Tarzana, CA (US); Wai Fun Salina Ha, Shatin (HK); Edward Kwok, Shatin (HK)

(73) Assignee: MUNCHKIN INC., Van Nuys, CA (US)

( * ) Notice: Subject to any disclaimer, the term of this patent is extended or adjusted under 35 U.S.C. 154(b) by 0 days.

(21) Appl. No.: 16/133,376

(22) Filed: Sep. 17, 2018

(65) Prior Publication Data

US 2019/0083896 A1 Mar. 21, 2019

Related U.S. Application Data

(60) Provisional application No. 62/559,453, filed on Sep. 15, 2017.

(51) Int. Cl.

| | |
|---|---|
| ***A63H 33/38*** | (2006.01) |
| ***A63H 3/14*** | (2006.01) |
| ***B42D 3/12*** | (2006.01) |
| ***B42D 1/00*** | (2006.01) |

(52) U.S. Cl.

CPC ..... *A63H 33/38* (2013.01); *A63H 3/14* (2013.01); *B42D 1/008* (2013.01); *B42D 3/12* (2013.01); *B42P 2241/16* (2013.01); *B42P 2241/20* (2013.01)

(58) Field of Classification Search

CPC . A63H 33/38; A63H 3/14; B42D 3/12; B42D 1/008; B42P 2241/20; B42P 2241/16

USPC ..... 446/41, 72, 83, 148, 151, 321, 327–329

See application file for complete search history.

(56) References Cited

U.S. PATENT DOCUMENTS

| | | | | | |
|---|---|---|---|---|---|
| 3,918,180 | A * | 11/1975 | Chamberlin | A63H 3/14 | 434/178 |
| 4,233,772 | A * | 11/1980 | Hamar | A63H 3/14 | 283/63.1 |
| 4,280,241 | A * | 7/1981 | Pfaff | B42D 1/008 | 281/29 |
| 4,874,340 | A * | 10/1989 | Smallwood | A47G 9/1045 | 446/28 |
| 5,915,729 | A * | 6/1999 | Vap | A63H 33/38 | 281/22 |

(Continued)

*Primary Examiner* — Nini F Legesse

(74) *Attorney, Agent, or Firm* — Robert Z. Evora, Esq.

(57) ABSTRACT

A bath book and a puppet combination and method of manufacturing a bath book and a puppet combination, wherein a first intermediate assembly is bonded to a second intermediate assembly to create a third intermediate assembly. A second jersey backing layer is secured to the third intermediate assembly to create a fourth intermediate assembly. The fourth intermediate assembly may be flipped inside-out through a hole opening in the second jersey backing layer. The hole may then be sealed. The second jersey backing layer may be pushed upwards into the further intermediate assembly. An adhesive film may be applied to the terry cloth ring and the non-woven material ring of the second intermediate assembly to create a puppet assembly. The puppet assembly is positioned into a center aperture in a book assembly and bonded therein.

20 Claims, 12 Drawing Sheets

(56) References Cited

U.S. PATENT DOCUMENTS

| | | | | |
|---|---|---|---|---|
| 6,929,526 | B1 * | 8/2005 | Cole | A63H 33/38<br>281/15.1 |
| 2006/0046935 | A1 * | 3/2006 | Burrows | B41M 5/035<br>503/227 |

* cited by examiner

BATH BOOK

CROSS REFERENCE TO RELATED APPLICATION

This application claims priority to U.S. Provisional Application Ser. No. 62/559,453 filed Sep. 15, 2017, the contents of all of which are hereby incorporated by reference herein in their entirety into this disclosure.

TECHNICAL FIELD

The subject disclosure relates generally to a waterproof book and puppet combination.

BACKGROUND

While there have been children's books used in aqueous environments, the construction of embedding a puppet in a waterproof book opens the risks of water reaching the interior portions between pages. The water that remains inside of the pages could cause mold and build up of other bacteria, which may be harmful to children and adults alike.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 2:
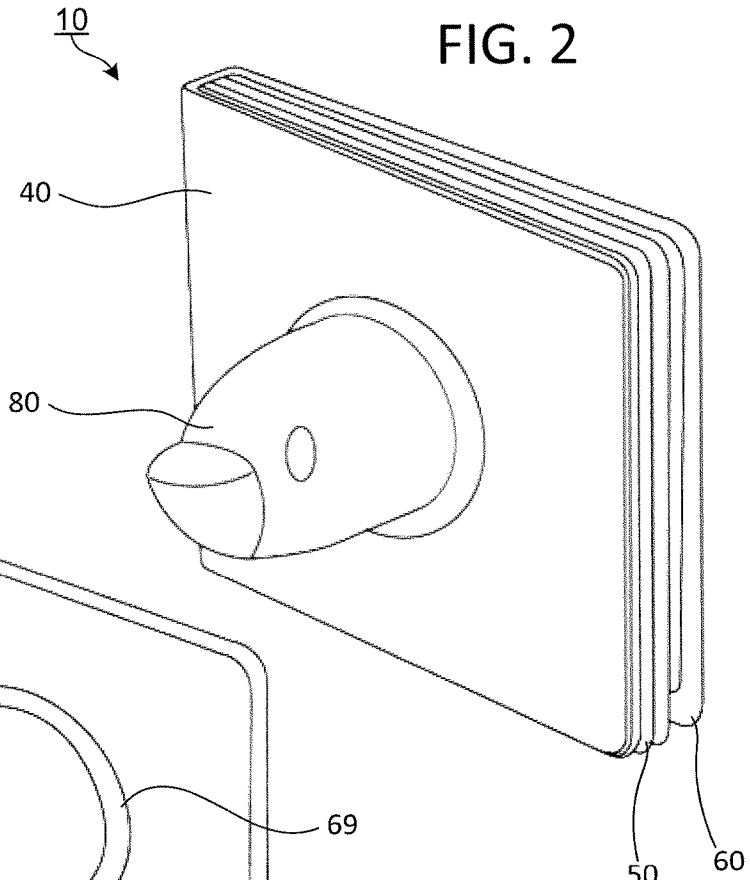
FIG. 2 shows FIG. 1 in a closed position.
Figure 1:
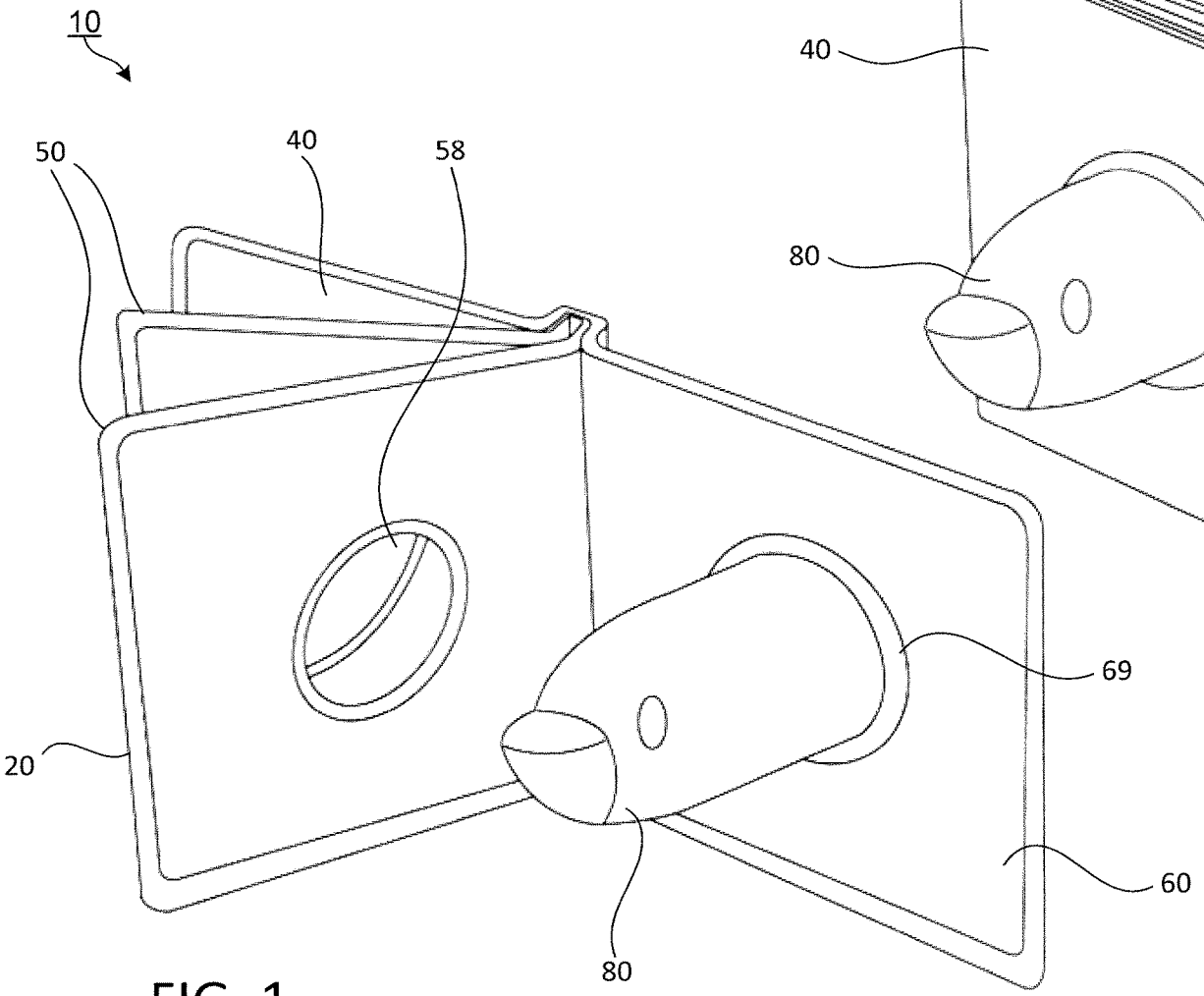
FIG. 1 illustrates the waterproof book and puppet combination according to this subject disclosure in an open position.

FIGS. 1 and 2 illustrates an exemplary waterproof book and puppet combination 10. The waterproof book and puppet combination 10 includes a book 20 having a plurality of pages 40, 50, 60. A finger puppet assembly 80 is attached by a watertight seal 69 to the back cover or last page 60 in the book 20. Various apertures 48, 58, 68 are provided in the pages 40, 50, 60 into which the puppet 80 can extend through so that a narrator reading the book 20 can animate the puppet 80 during the narration of the book 20 in an educational and entertaining manner. A portion of the narrator's hand can be disposed along the back side of the puppet assembly 80 and can move their hand in the puppet 80 to animate the puppet assembly 80 during the narration.

Figure 3:
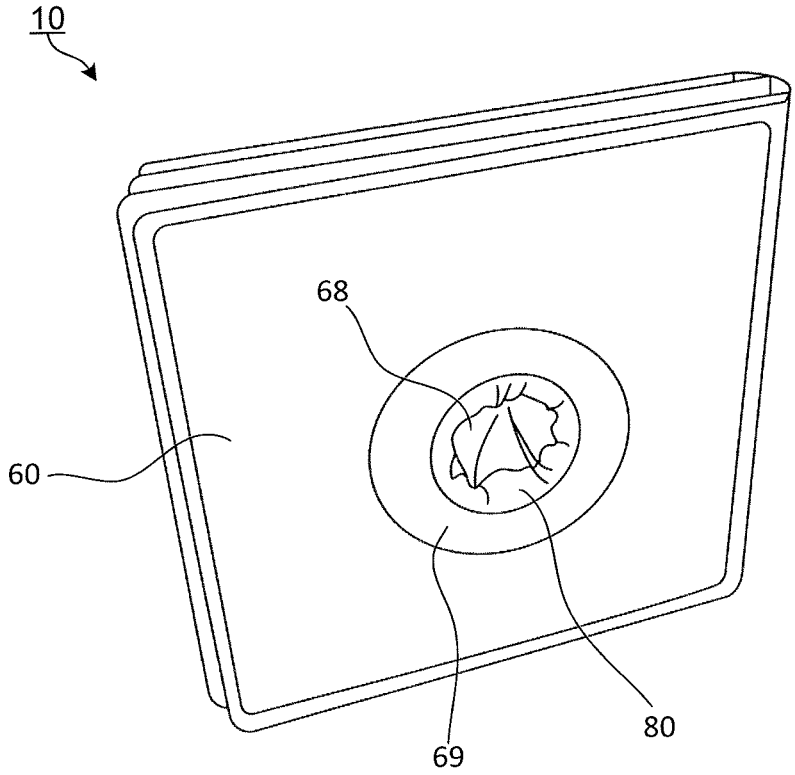
FIG. 3 demonstrates a back cover of FIG. 2 in the closed position.
Figure 4:
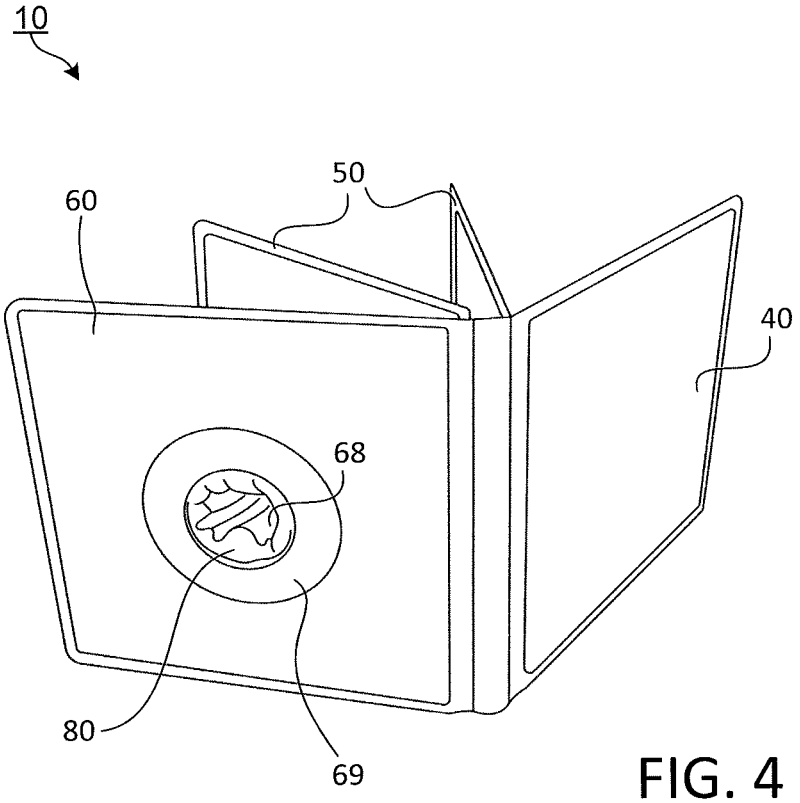
FIG. 4 portrays the back cover of FIG. 1 in the open position.

FIGS. 3 and 4 demonstrate an opposing view of the waterproof book and puppet combination 10. The puppet assembly 80 is attached to the last page 60 of the waterproof book and puppet combination 10 in a watertight manner. To accomplish this, the back cover 60 may have a central aperture 68. The puppet assembly 80 may be sealed in the central aperture 68 of the back cover 60 via the inner seal 69, which will be described in greater detail below.

Although the puppet assembly 80 is shown as a generally tubular geometric shape fitting a user's finger, it is to be understood that the puppet assembly 80 may take any suitable geometric shape or size for a user to manipulate and animate. For example, the puppet assembly 80 may be shaped to accommodate an adult or child user's entire hand.

Figure 5:
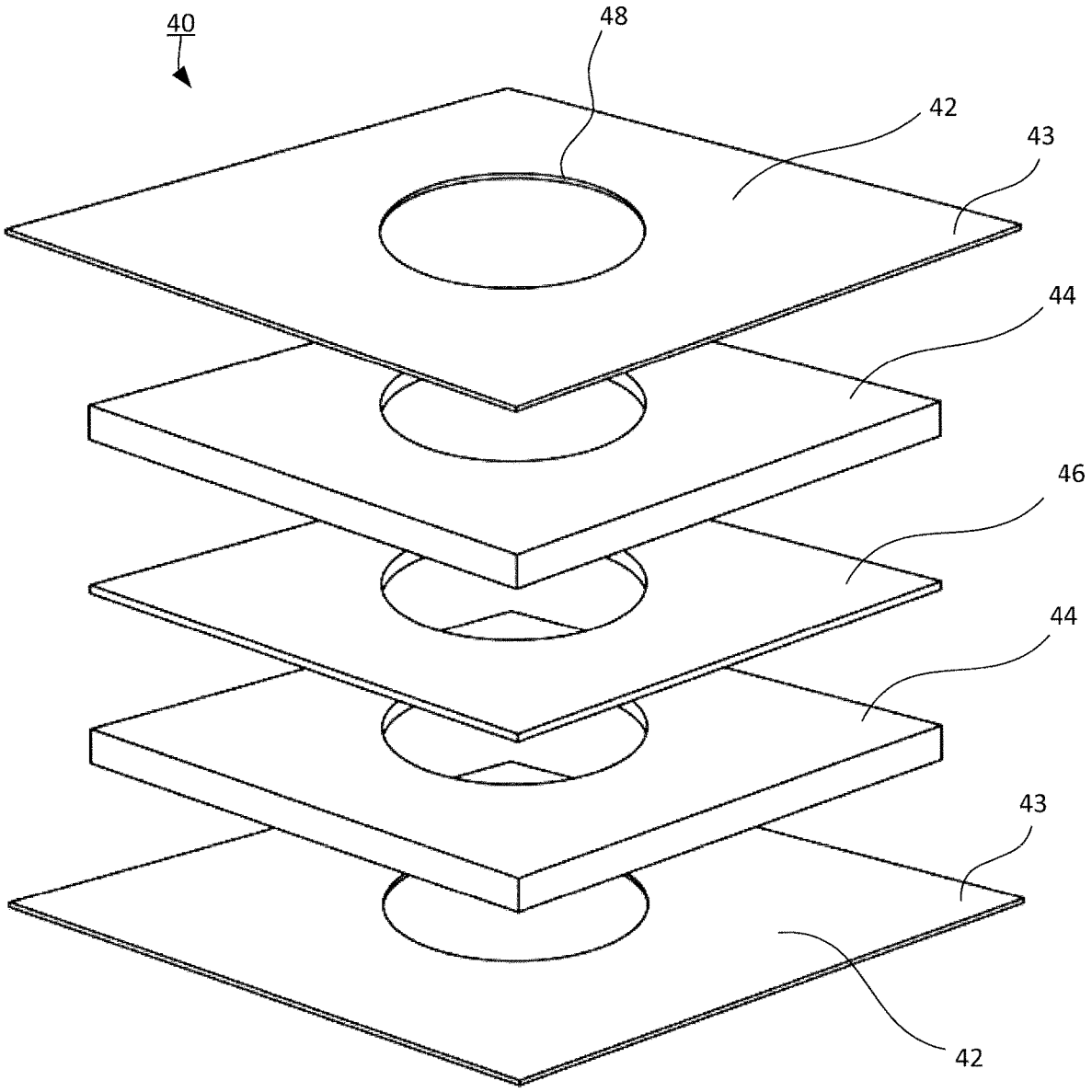
FIG. 5 illustrates an exploded view of a front cover of FIG. 1.

FIG. 5 is a detailed exploded view of the construction of the front cover 40 of the waterproof book and puppet combination 10. The front cover 40 may have a polyvinyl chloride (PVC) sheet 42, a layer of polyurethane (PU) foam 44, and a polyethylene (PE) sheet 46. The PVC sheet 42 provides the book pages 30 with a material that is waterproof. Furthermore, the PVC sheet 42 retains the ability to create a waterproof seal (as similarly shown at 63 in FIG. 18) when edges 43 of the PVC sheet 42 high frequency welded. The layer of PU foam 44 provides the book pages 30 with a soft material, which protects the user and the child. The PE sheet 46 is a semi rigid material adapted to provide stiffness to the front cover 40 of the waterproof book and puppet combination 10. As shown, the PE sheet 46 may have a layer of PU foam 44 on either or both sides. Similarly, there may be PVC sheets 42 on either or both sides of the PU foam 44 and PE sheet 46. Each of these layers and sheets 42, 44, 46 may have a central aperture 48 to allow the puppet assembly 80 to fit therethrough.

Figure 6:
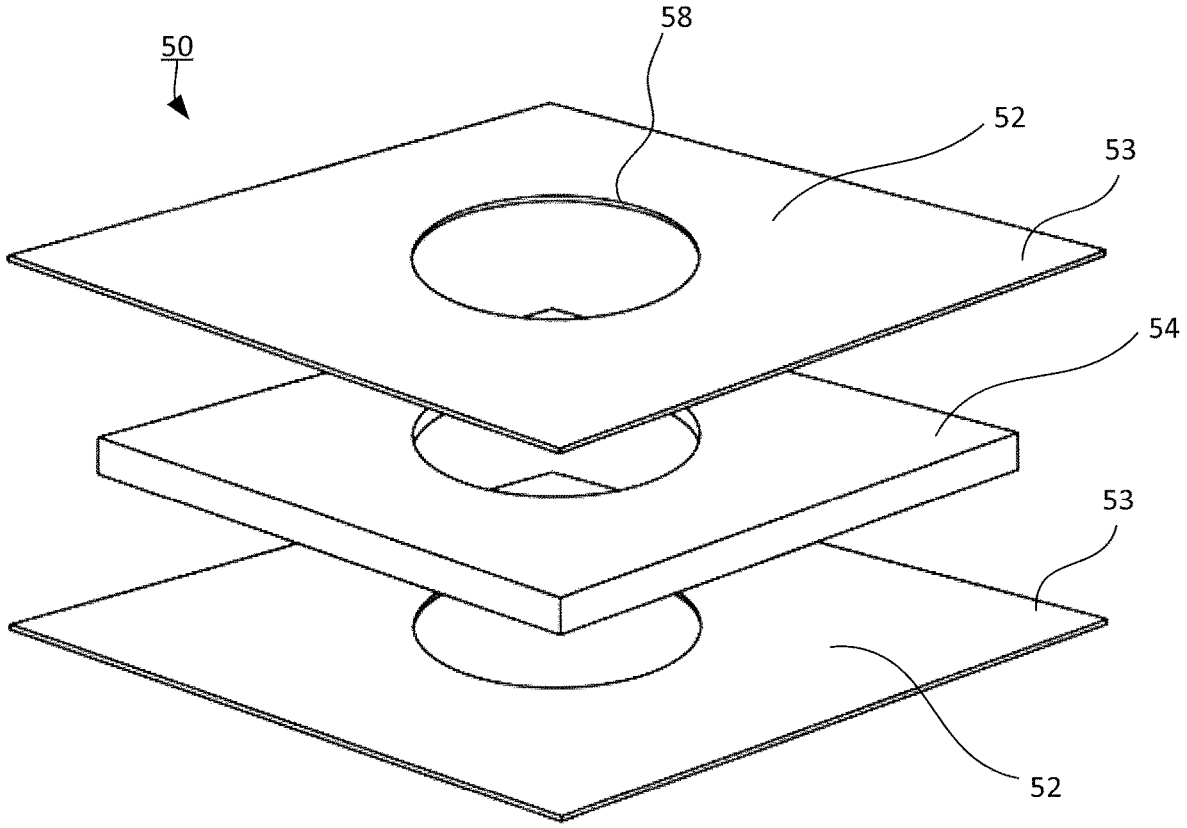
FIG. 6 depicts an exploded view of a middle page of FIG. 1.

FIG. 6 is an exploded view of a middle or intermediate page 50 of the waterproof book and puppet combination 10. The middle page 50 is similar to the front cover 40 in construction but may not obtain the rigidity from the PE sheet 46. More specifically, the middle page 50 may have a PVC sheet 52 for waterproofing and a layer of PU foam 54 for a soft feeling material. Similarly, the PVC sheet 52 and PU foam layer 54 may have a central aperture 58 disposed therein to allow the puppet assembly 80 to fit therethrough.

Figure 7:
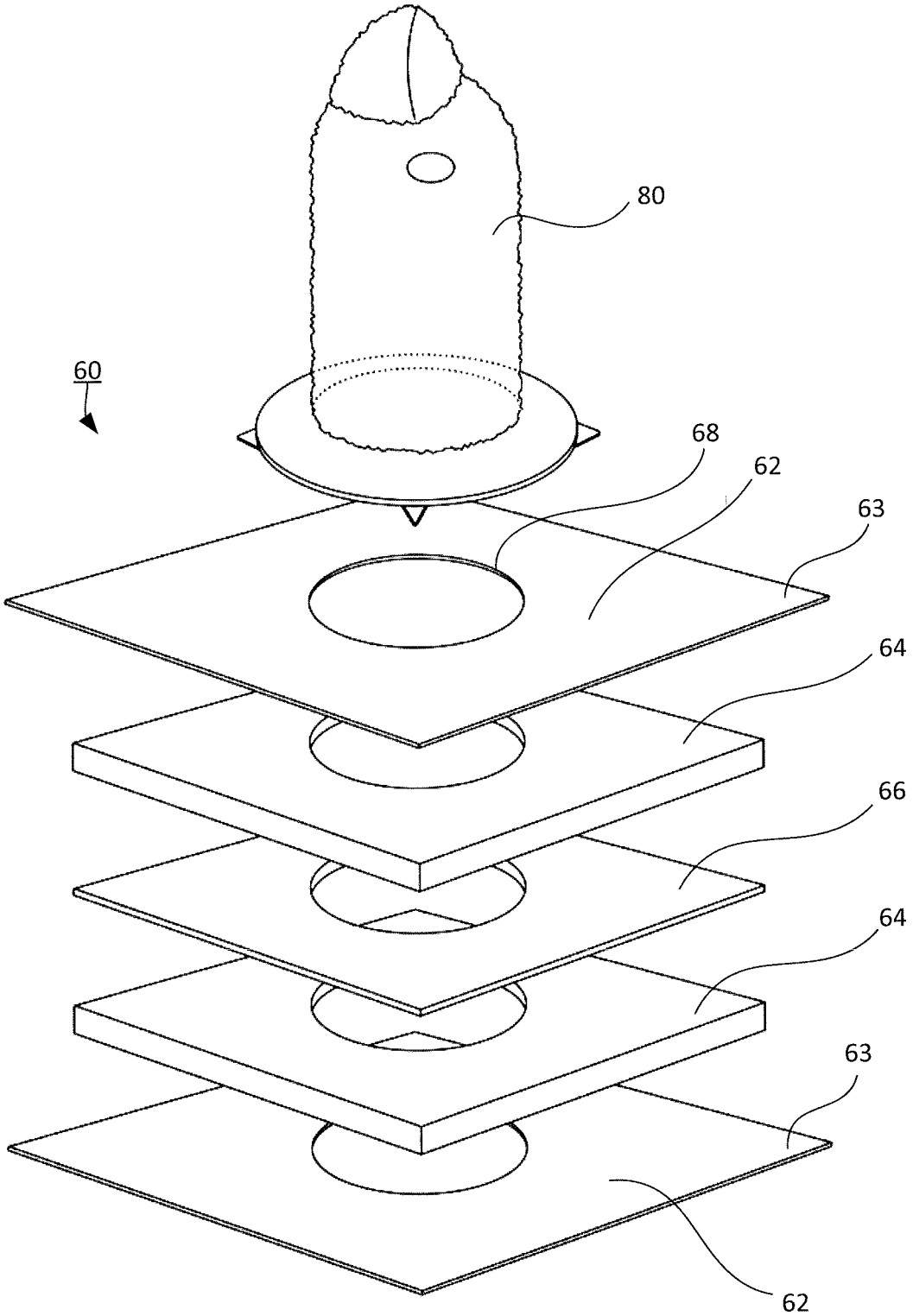
FIG. 7 shows an exploded view of the back cover of FIG. 1.

FIG. 7 shows an exploded view of the back cover book page 60 with the puppet assembly 80 prior to the waterproof installation of the puppet assembly 80. The back cover 60 is similar to the front cover 40 in construction but may further include the puppet assembly 80. More specifically, the back cover 60 may have a puppet assembly 80 as described below, a PVC sheet 62 to retain waterproofing and an inner seal 69 (FIG. 19), a layer of PU foam 64 to maintain the soft feeling material, and a PE sheet 66 to provide rigidity to the back cover 60 of the book assembly 20. Similarly, the PVC sheet 62, PU foam layer 64 and PE sheet 66 all may have the central aperture 68 to allow the puppet assembly 80 to fit therethrough.

Figure 8:
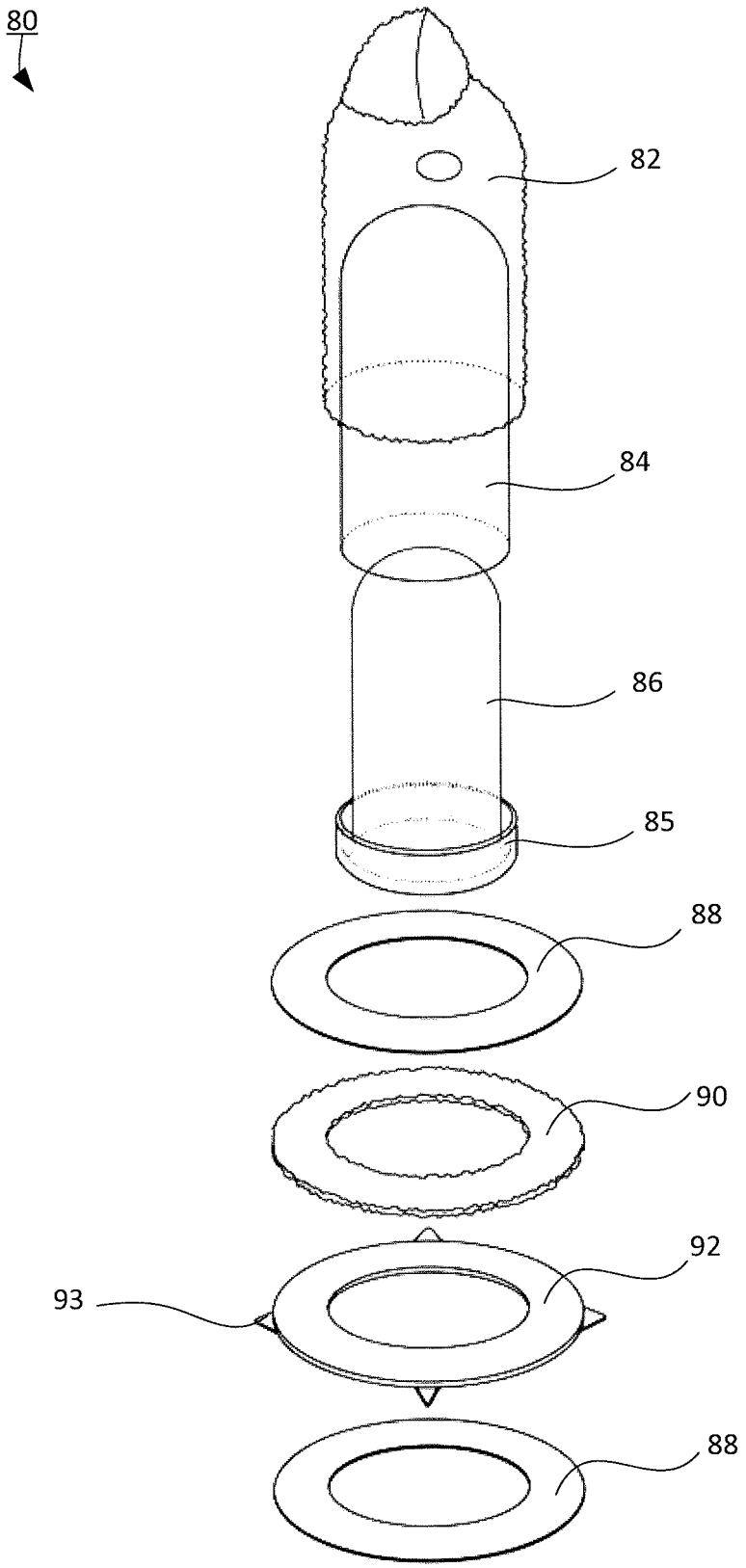
FIG. 8 demonstrates an exploded view of a puppet assembly disposed in the back cover of FIG. 1.

FIG. 8 is an exploded view of the puppet assembly 80 of the waterproof book and puppet combination 10. The puppet assembly 80 may have a terry cloth outer material 82, a jersey backing first layer 84, a jersey backing second layer 86, an end of the jersey backing second layer 85, an adhesive film 88, a terry cloth ring 90, and a non-woven material ring 92. The various layers are connected to each other to define the puppet assembly 80 shown in FIG. 7.

The adhesive film 88 may be selected from a variety of different adhesives, such as for example, an adhesive film having a composition of 100% or less thermoplastic polyurethanes (TPU). It is to be understood that any type of adhesive may be used as long as the adhesive film on the top surface of the terry cloth and the bottom surface of the non-woven fabric ring 92 creates the water proof inner seal 69 against the PVC sheet 62.

The non-woven fabric ring 92 creates a flat/rigid platform to help locate and fix the puppet assembly 80 easily inside the book assembly 20 for mass production. Furthermore, the non-woven fabric ring 92 may be made of polypropylene or any other non-woven fabric that provides rigidity to help locate a base of the puppet assembly 80 inside the book assembly 20 during mass production. The non-woven material ring 92 may have protrusions 93, which provide further rigidity to the non-woven material ring and more surface area to attach other materials thereto.

FIGS. 9-19 illustrate the step by step process for constructing the waterproof book and puppet combination 10.

More specifically, FIGS. 9-16 show steps 1 through 8, during which the puppet assembly 80 is constructed.

Figure 9:
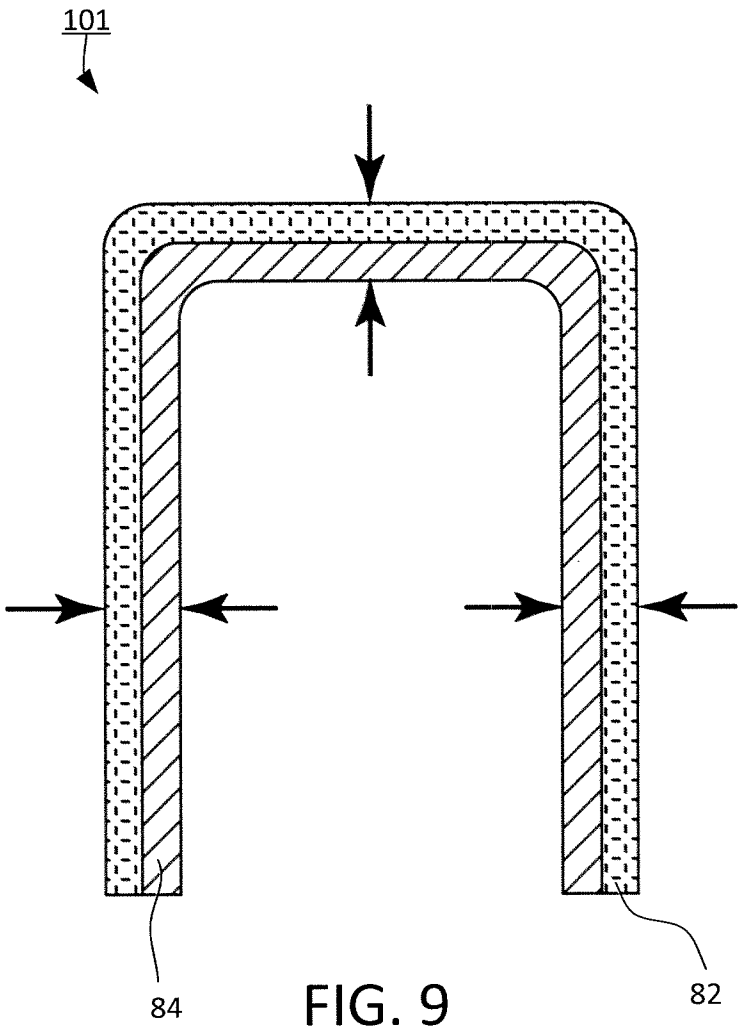
FIG. 9 portrays a first step in making the waterproof book and puppet combination.

FIG. 9 shows that the terry cloth outer material 82 is bonded to the jersey backing first layer 84 to create a first intermediate assembly 101 in the shape of a pocket. In other words, the terry cloth outer material 82 and the jersey backing first layer 84 are interconnected such that the two materials become one integral unit, the first intermediate assembly 101. For example, the terry cloth outer material 82 may be bonded to the jersey backing first layer 84 via lamination and/or any other suitable bonding technique, including, but not limited to welding, pressure or adhesives.

Figure 10:
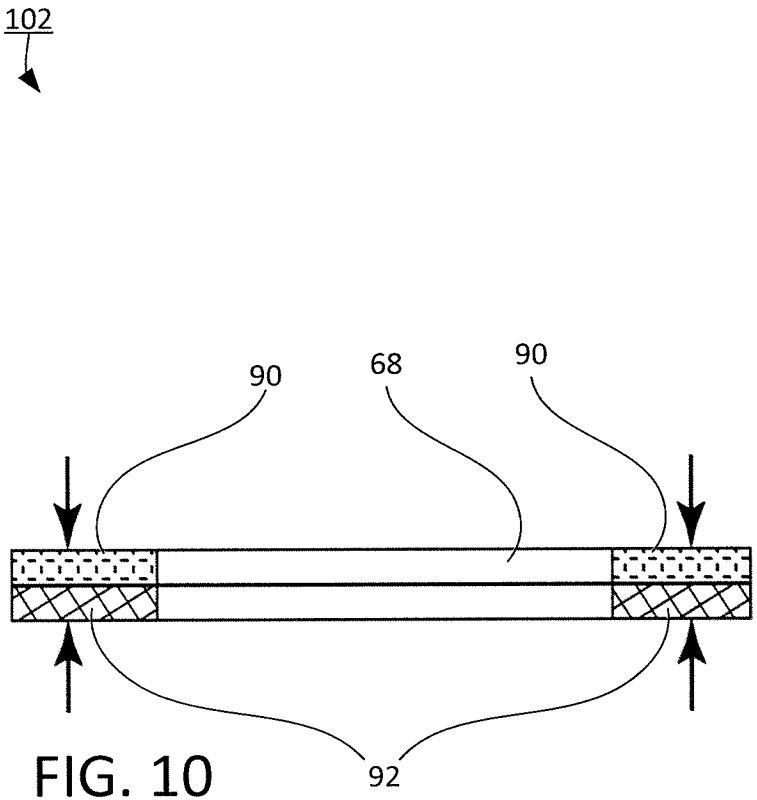
FIG. 10 depicts a second step in making the waterproof book and puppet combination.

FIG. 10 demonstrates that the terry cloth ring 90 is bonded to the non-woven material 92 to create a second intermediate assembly 102. For example, the terry cloth ring 90 may be laminated or otherwise bonded to the non-woven material 92.

Figure 11:
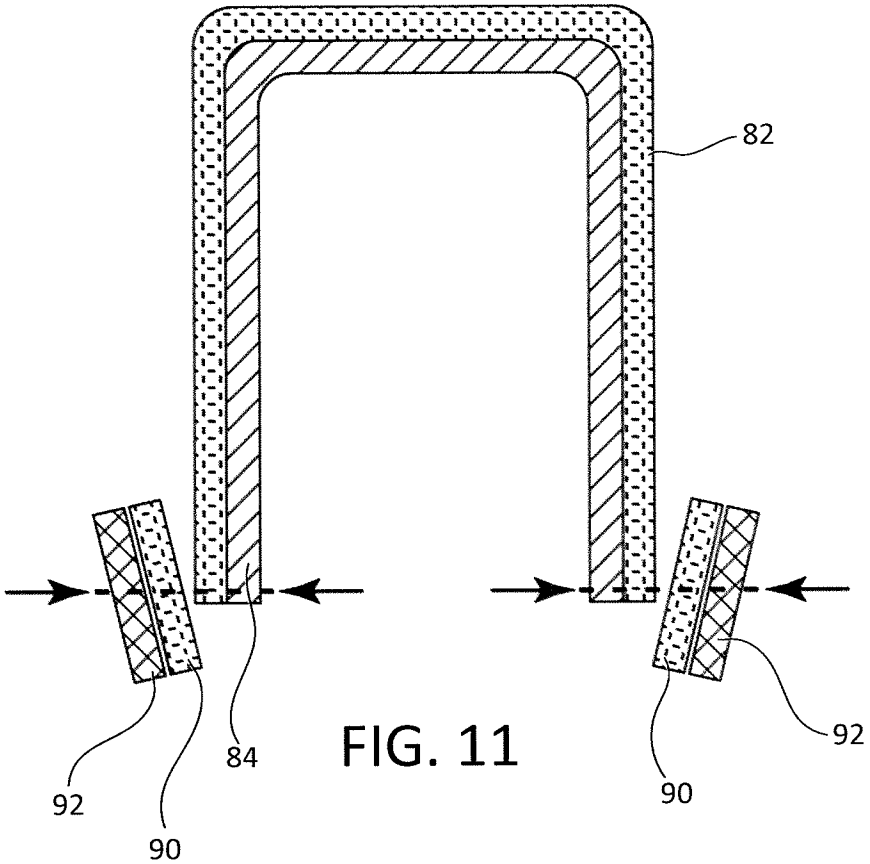
FIG. 11 illustrates a third step in making the waterproof book and puppet combination.

FIG. 11 portrays sewing (as depicted by arrows and dashed lines) the terry cloth outer material 82 and jersey backing first layer 84 assembly to the terry cloth ring 90 and non-woven material 92 assembly. In other words, the first intermediate assembly 101 is sewed to the second intermediate assembly 102 to create a third intermediate assembly 103.

Figure 12:
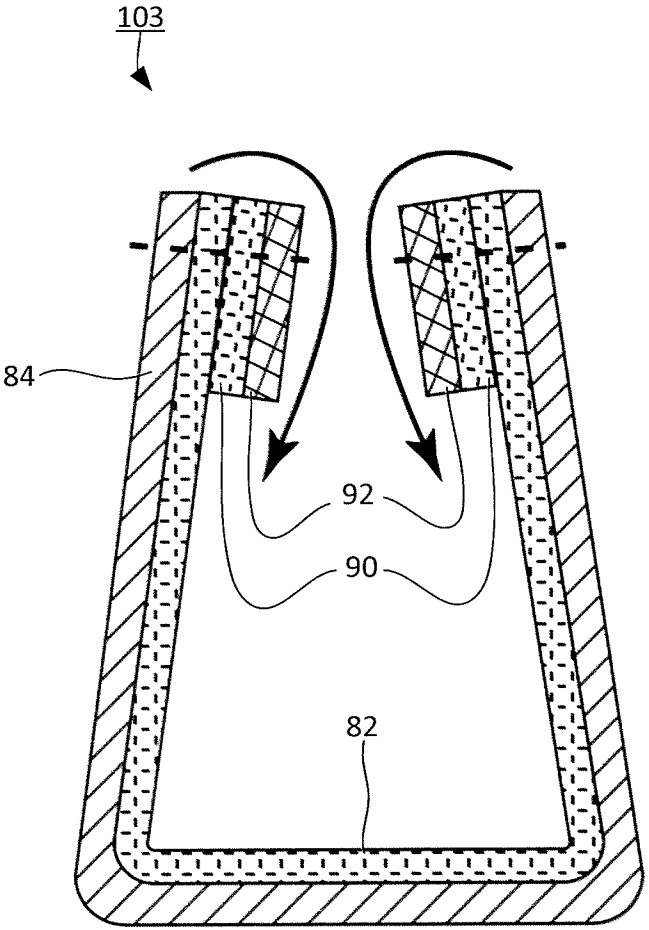
FIG. 12 shows a fourth step in making the waterproof book and puppet combination.

FIG. 12 depicts inverting by flipping the terry cloth outer material 82, jersey backing first layer 84, terry cloth ring 90 and non-woven material 92 assembly outside-in.

Figure 13:
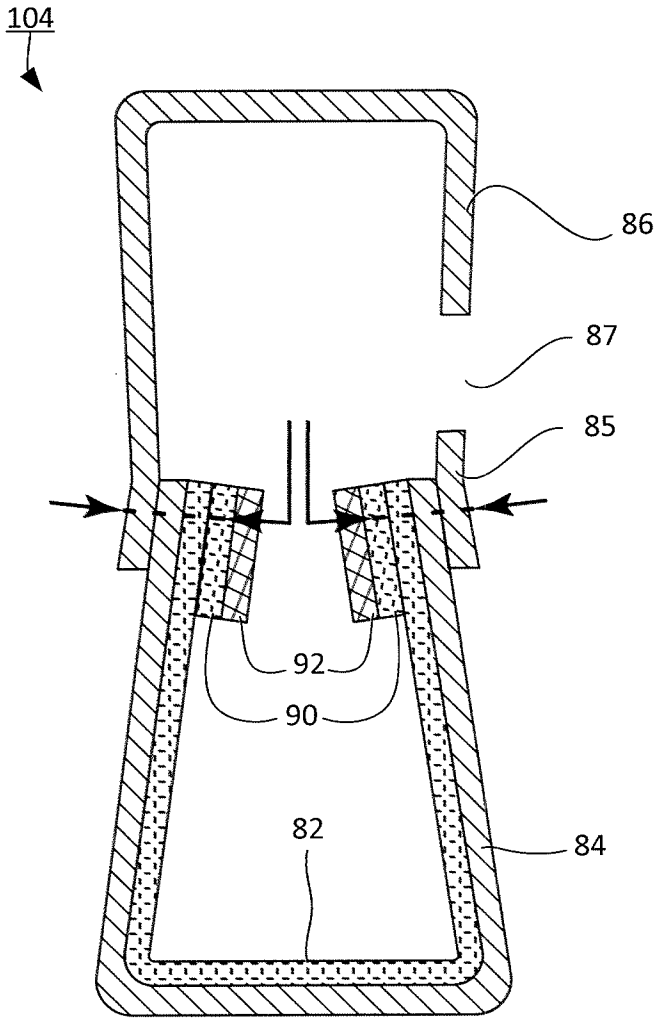
FIG. 13 portrays a fifth step in making the waterproof book and puppet combination.

FIG. 13 illustrates sewing the end 85 of jersey backing second layer 86 to the outside-in terry cloth outer material 82, jersey backing first layer 84, terry cloth ring 90 and non-woven material 92 assembly. In other words, the jersey backing second layer 86 is sewed to the third intermediate assembly 103 to create a fourth intermediate assembly 104.

Figure 14:
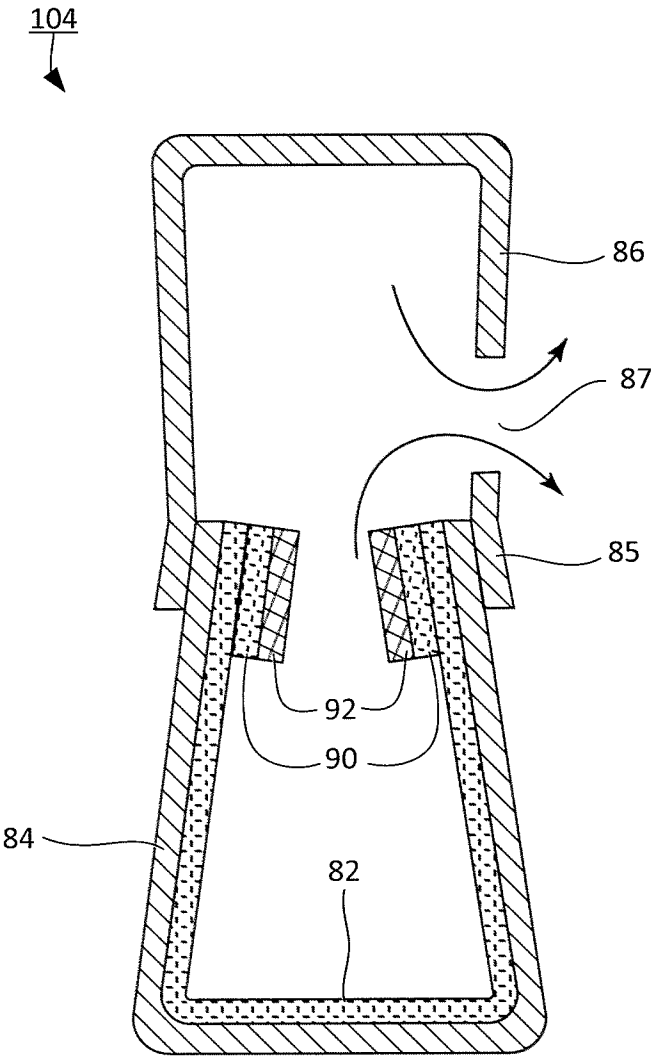
FIG. 14 demonstrates a sixth step in making the waterproof book and puppet combination.

FIG. 14 shows flipping the terry cloth outer material 82, jersey backing first layer 84, terry cloth ring 90, non-woven material 92, and jersey backing second layer 86 assembly inside-out using a hole opening 87 in 2nd jersey backing. More specifically, the fourth intermediate assembly 104 may be flipped inside-out using the hole opening 87 in the jersey backing second layer 86.

Figure 15:
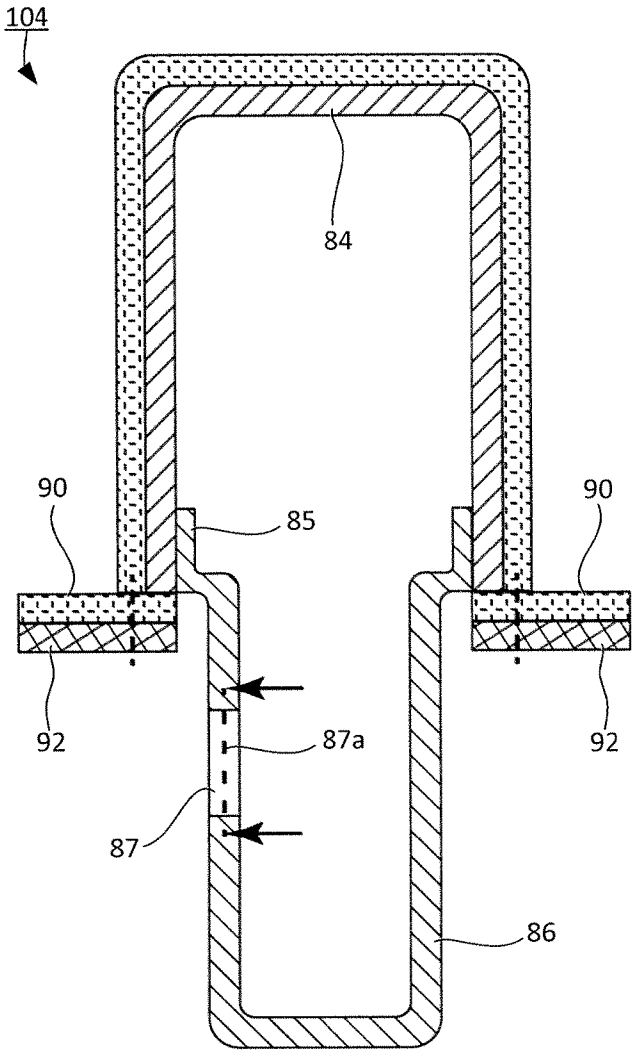
FIG. 15 depicts a seventh step in making the waterproof book and puppet combination.

FIG. 15 demonstrates pulling the jersey backing second layer 86 down and securing the hole 87 closed. The hole 87 may be hand stitched 87*a* closed.

Figure 16:
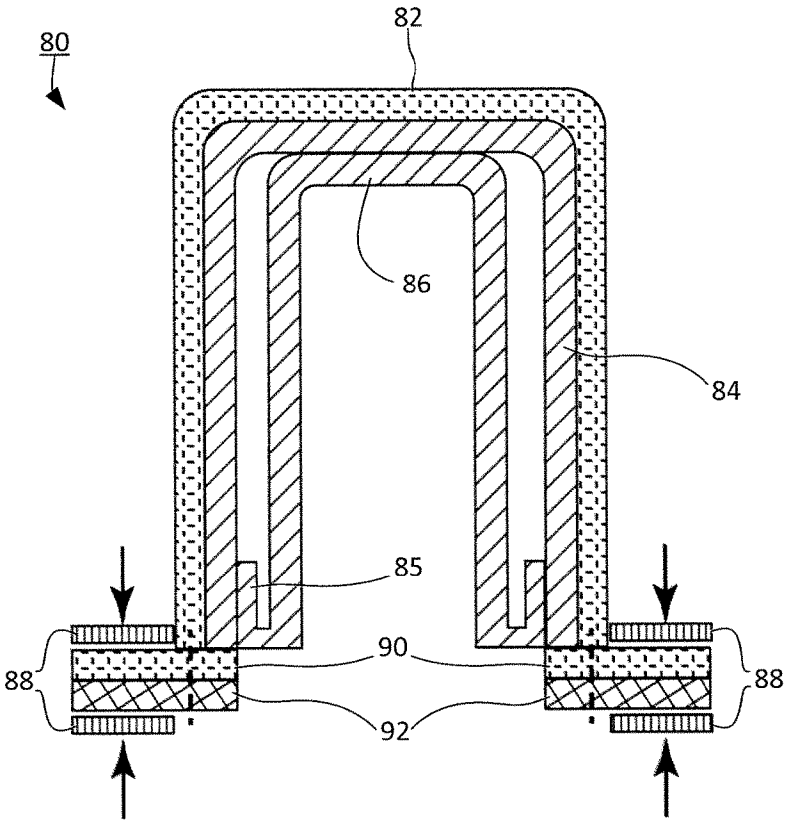
FIG. 16 shows an eighth step in making the waterproof book and puppet combination.

FIG. 16 portrays pushing the jersey backing second layer 86 upwards and into the puppet assembly 80 and applying an adhesive film 88 to the terry cloth ring 90 and the non-woven material ring 92 to complete the puppet assembly 80.

Figure 17:
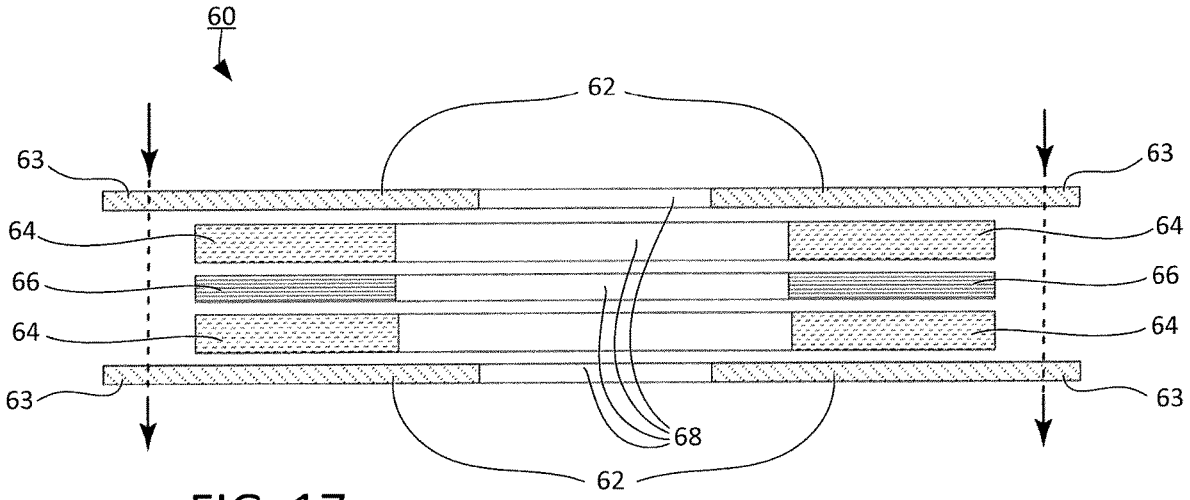
FIG. 17 illustrates a ninth step in making the waterproof book and puppet combination.

FIG. 17 demonstrates step 9, during which the book pages form a waterproof seal around the periphery of the various pages prior to installation of the puppet assembly in the center aperture.

FIG. 17 depicts aligning the PVC sheet 62, the PU foam sheet 64, the PE sheet 66, another PU foam sheet 64 and another PVC sheet 62. FIG. 17 further depicts bonding peripheries of the PVC sheets 62 together to create the back cover 60, such that the PU foam sheet 64 and the PE sheet 66 remain therein. For example, PVC sheets 62, PU foam 64 and PE sheet 66 may be bonded through high frequency welding. High Frequency welding is a process during which different layers are treated with a high-frequency of radio waves to heat to the melting point and form a melted layer of the two layers. The parts are then pressed together and allowed to cool and bond. Other methods of bonding the PVC sheets 62, PU foam 64 and PE sheet 66 may include lamination, adhesives, ultrasonic welding, during which high-frequency ultrasonic acoustic vibrations are applied to create a solid-state weld, and other suitable methods of waterproof bonding.

Although not shown, the front cover 40 may be constructed in the same method depicted in FIG. 17, using the PVC sheet 42, the PU foam sheet 44, the PE sheet 46 another PU foam sheet 44, and another PVC sheet 42.

Figure 18:
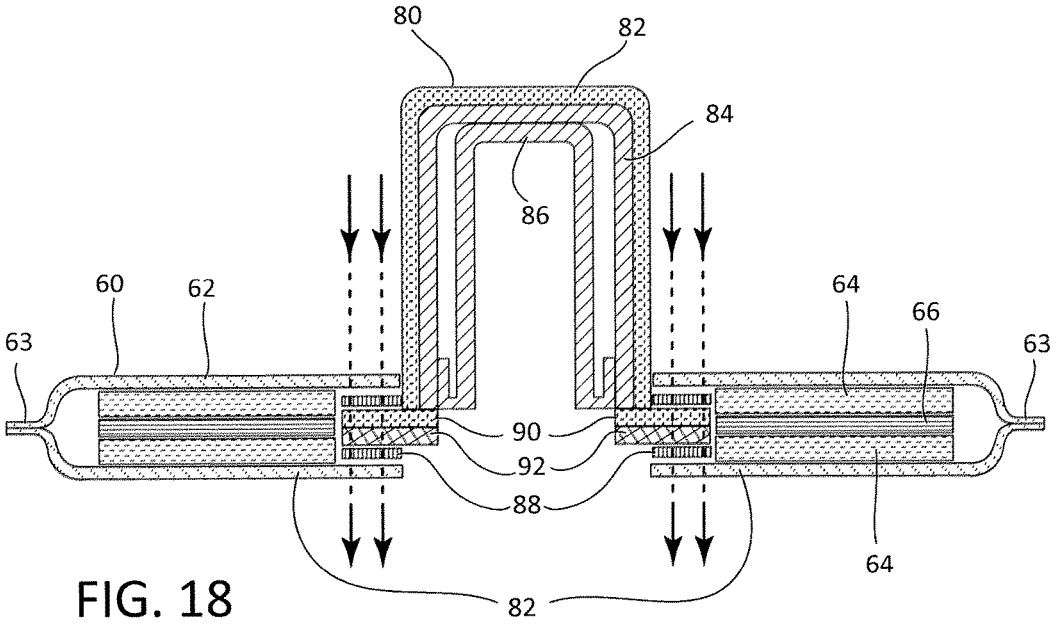
FIG. 18 portrays a tenth step in making the waterproof book and puppet combination.

FIG. 18 shows the puppet assembly 80 being secured into the central aperture 68 of the back cover 60. FIG. 18 contemplates using high frequency welding of all layers around the center aperture 68 around the puppet assembly 80.

In particular, FIG. 18 further illustrates the assembly of the puppet assembly 80 into the rear cover 60 of the book 20 and the high frequency weld (HF) process that is applied to the periphery of the puppet assembly 80 and the rear cover 60 of the book 20 (as shown by arrows and dashed lines) to seal the puppet assembly 80 therein in a watertight manner so that a liquid cannot be transferred from the puppet assembly 80 to within the interior of the book cover 60.

Figure 19:
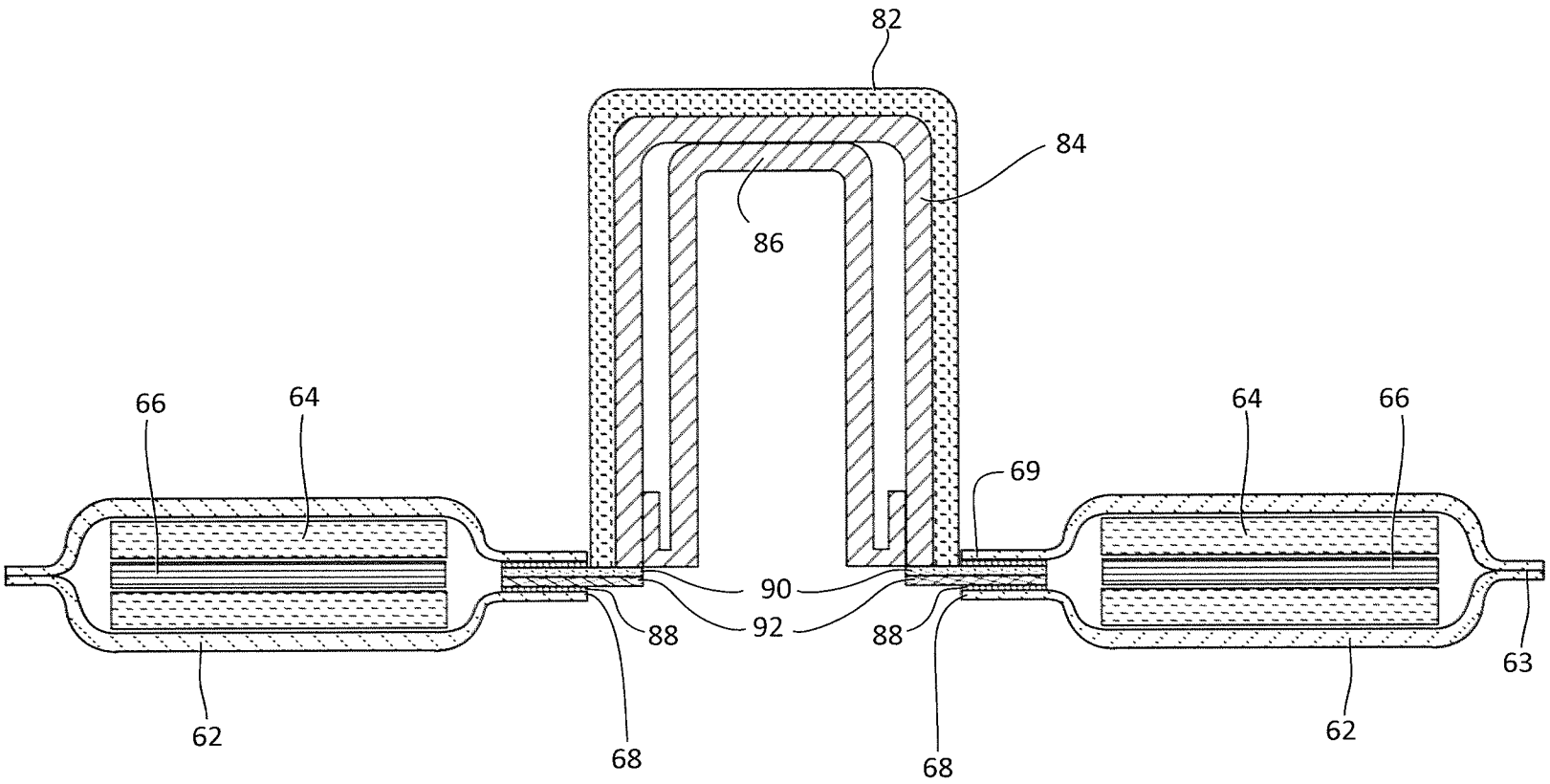
FIG. 19 demonstrates an eleventh step in making the waterproof book and puppet combination.

FIG. 19 shows completion of the high frequency weld process at the inner seal 69 that has been formed adjacent to the central apertures 68 of the waterproof book and puppet combination 10.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A method of manufacturing a bath book and a puppet combination comprising:

bonding a first intermediate assembly to a second intermediate assembly to create a third intermediate assembly;

securing a second jersey backing layer to the third intermediate assembly to create a fourth intermediate assembly;

flipping the fourth intermediate assembly inside-out through a hole opening in the second jersey backing layer;

sealing the hole;

pushing the second, jersey backing layer upward and applying an adhesive film to a terry cloth ring and a non-woven material ring of the second intermediate assembly to create a puppet assembly;

positioning the puppet assembly into a center aperture in a book assembly; and bonding the puppet assembly to the center aperture.

2. The method of manufacturing a bath book and a puppet combination in claim 1, wherein the first intermediate assembly comprises a terry cloth outer material laminated to a first jersey backing layer.

3. The method of manufacturing a bath book and a puppet combination in claim 1, wherein the second intermediate assembly comprises a terry cloth ring bonded to a non-woven material ring.

4. The method of manufacturing a bath book and a puppet combination in claim 1 further comprising:

aligning a first waterproof layer, a layer of soft material, a layer of rigid material and a second waterproof layer;

bonding peripheries of the first and second waterproof layer together to create a page; and bonding the first waterproof layer, the layer of soft material, the layer of rigid material and the second waterproof layer around the central aperture around the puppet assembly.

5. The method of manufacturing a bath book and a puppet combination in claim 4, wherein the page comprises securing the layer of soft material and the layer of rigid material and defining a central aperture in the page.

6. The method of manufacturing a bath book and a puppet combination in claim 4, wherein the page is a waterproof page.

7. The method of manufacturing a bath book and a puppet combination in claim 4, wherein the bonding of the peripheries of the first and second waterproof layer together is via high frequency welding.

8. The method of manufacturing a bath book and a puppet combination in claim 4, wherein a waterproof page is provided by bonding the first waterproof layer, the layer of soft material, the layer of rigid material and the second waterproof layer around the cc astral aperture around the puppet assembly.

9. A bath book and a puppet combination comprising:

a first page;

a second page attached to the first page comprising:

a first waterproof layer;

a layer of rigid material;

a layer of soft material disposed between the first waterproof layer and the layer of rigid material;

a second waterproof layer disposed on an opposing side of the layer of rigid material;

a central aperture through the second page; and a puppet assembly is bonded to the central aperture of the second page.

10. The bath book and the puppet combination in claim 9, wherein the central aperture is disposed through the first waterproof layer, the layer of rigid material, the layer of soft material and the second waterproof layer of the second page.

11. The bath book and the puppet combination in claim 10, wherein the puppet assembly is bonded to the central aperture of the second page by a high frequency welding process.

12. The bath book and puppet combination in claim 10, wherein a waterproof seal bonds the puppet assembly to the central aperture of the second page.

13. The bath book and the puppet combination in claim 10, wherein the puppet assembly comprises:

a terry cloth outer material;

a first jersey backing layer attached to the terry cloth outer material;

a second jersey backing layer attached to the first jersey backing layer;

a terry cloth ring attached to the terry cloth outer material and the first jersey backing layer;

a nonwoven material ring attached to the terry cloth ring;

a first adhesive film attached to the terry cloth ring; and a second adhesive film attached to the non-woven material ring.

14. The bath hook and the puppet combination in claim 10, wherein the first page comprises:

a first first-page waterproof layer;

a second first-page waterproof layer;

first-page layer of soft material disposed between the first first-page waterproof layer and the second first-page waterproof layer; and a central aperture through the first page.

15. A bath book and a puppet combination comprising:

a first page;

a second page attached to the first page; and a puppet assembly bonded to the second page comprising;

a terry cloth outer material;

a first jersey backing layer attached to the terry cloth outer material;

a second jersey backing layer attached to the first jersey backing layer;

a terry cloth ring attached to the terry cloth outer material and the first jersey backing layer;

a non-woven material ring attached to the terry cloth ring;

a first adhesive film attached to the terry cloth ring; and a second adhesive film attached to the non-woven material ring.

16. The bath book and the puppet combination in claim 15, wherein the second page comprises:

a first waterproof layer;

a layer of rigid material;

a layer of soft material disposed between the first waterproof layer and the layer of rigid material;

a second waterproof layer disposed on an opposing side of the layer of rigid material; and a central aperture through the second page.

17. The bath book and the puppet combination in claim 16, wherein the central aperture is disposed through the first waterproof layer, the layer of rigid material, the layer of soft material and the second waterproof layer of the second page.

18. The bath book and the puppet combination in claim 16, wherein the puppet assembly is bonded to the central aperture of the second page by a high frequency welding process.

19. The bath book and puppet combination in claim 16, wherein a waterproof seal bonds the puppet assembly to the central aperture of the second page.

20. The bath hook and puppet combination in claim 15, wherein the first page comprises:

a first waterproof layer;

a second waterproof layer;

a layer of soft material disposed between the first waterproof layer and the second waterproof layer; and a central aperture through the first page.

* * * * *